US010858154B2

(12) United States Patent
Sullivan et al.

(10) Patent No.: US 10,858,154 B2
(45) **Date of Patent: *Dec. 8, 2020**

(54) PORTABLE DRINKING VESSEL ASSEMBLY

(71) Applicant: J JO MARKET LLC, Medford, OR (US)

(72) Inventors: Jennifer Jo Sullivan, Medford, OR (US); Randall Allen Rothfus, Medford, OR (US)

(73) Assignee: J JO MARKET LLC, Medford, OR (US)

( * ) Notice: Subject to any disclaimer, the term of this patent is extended or adjusted under 35 U.S.C. 154(b) by 15 days.

This patent is subject to a terminal disclaimer.

(21) Appl. No.: 16/060,842

(22) PCT Filed: Oct. 4, 2017

(86) PCT No.: PCT/US2017/055195

§ 371 (c)(1),
(2) Date: Jun. 8, 2018

(87) PCT Pub. No.: WO2018/080749

PCT Pub. Date: May 3, 2018

(65) Prior Publication Data

US 2018/0370693 A1 Dec. 27, 2018

Related U.S. Application Data

(60) Provisional application No. 62/412,805, filed on Oct. 25, 2016.

(51) Int. Cl.
*B65D 41/26* (2006.01)
*B01F 5/06* (2006.01)
(Continued)

(52) U.S. Cl.
CPC ..... *B65D 41/265* (2013.01); *A47G 19/2255* (2013.01); *B01F 3/04099* (2013.01);
(Continued)

(58) Field of Classification Search
CPC ..... B65D 41/265; B65D 47/06; B65D 43/02; B01F 13/002; B01F 3/04099;
(Continued)

(56) References Cited

U.S. PATENT DOCUMENTS 2,169,426 A 8/1939 Morton
2,582,934 A 7/1949 Parsons
(Continued)

FOREIGN PATENT DOCUMENTS

CH 704487 A2 8/2012
CN 2298213 11/1998
(Continued)

OTHER PUBLICATIONS

Cougar Town, Guzzle Buddy Too Much Ain't Enough, www.youtube.com/watch?v=noVx38vF8LY, Mar. 4, 2014, TBS.
Translation of DE 2641874 (Kolbel, Mar. 23, 1978, pp. 2-3.

*Primary Examiner* — Qingzhang Zhou
(74) *Attorney, Agent, or Firm* — Jerry Haynes Law

(57) ABSTRACT

A portable drinking vessel assembly removably engages an open end of a bottle neck to enable drinking directly from a bottle while aerating the liquid. The assembly comprises a vessel defined by a side wall, a bottom portion forming a bottom opening, and a top portion forming a top opening. A tapered conduit defined by a wide end and a narrow end integrally joins with the vessel through the wide end, and detachably attaches to the bottle through the narrow end. The liquid is aerated while flowing from narrow end, to wide end, and finally into the vessel. A silicone sleeve having ribs encapsulates a longitudinal portion of the conduit. The ribs
(Continued)

engage an inner surface of the bottle neck to create a self-tapping rotatable action in the bottle neck, and a seal against the inner surface of bottle neck. The vessel joins a stand to remain upright.

11 Claims, 7 Drawing Sheets

(51) Int. Cl.

| | |
|---|---|
| ***B01F 13/00*** | (2006.01) |
| ***A47G 19/22*** | (2006.01) |
| ***B01F 3/04*** | (2006.01) |
| ***B65D 43/02*** | (2006.01) |
| ***B65D 47/06*** | (2006.01) |

(52) U.S. Cl.
CPC ..... *B01F 5/0653* (2013.01); *B01F 13/002* (2013.01); *B65D 43/02* (2013.01); *B65D 47/06* (2013.01); *B01F 2215/0072* (2013.01)

(58) Field of Classification Search
CPC ..... B01F 5/0653; B01F 2215/0072; B01F 13/04099; A47G 19/2255
USPC ..... 222/500, 476–477, 481.5, 547, 566–567, 222/569
See application file for complete search history.

(56) References Cited

U.S. PATENT DOCUMENTS

| | | | | |
|---|---|---|---|---|
| 2,827,194 | A | 3/1958 | Matton | |
| 3,021,977 | A | 4/1960 | Hester | |
| 4,119,334 | A | 10/1978 | Steed | |
| 4,217,941 | A | 8/1980 | Catalano | |
| 4,416,381 | A | 11/1983 | Swartwout | |
| D324,973 | S | 3/1992 | Slagerman | |
| 5,402,907 | A | 4/1995 | Liu | |
| 5,685,351 | A | 11/1997 | Kazarian et al. | |
| 6,209,737 | B1 | 4/2001 | Bliss | |
| 6,662,959 | B1 | 12/2003 | Westerhold | |
| 7,182,216 | B2 | 2/2007 | Reinoso | |
| 7,543,978 | B2 * | 6/2009 | Clement | A47J 43/1093 215/364 |
| 8,365,964 | B2 * | 2/2013 | Federighi | B65D 47/06 222/190 |
| 8,556,136 | B2 * | 10/2013 | Huynh | B65D 47/20 222/500 |
| D719,409 | S | 12/2014 | Wampold | |
| 8,944,265 | B2 | 2/2015 | Blake | |
| 9,321,019 | B2 | 4/2016 | Stevenson et al. | |
| 2002/0153344 | A1 | 10/2002 | Pola et al. | |
| 2004/0118804 | A1 | 4/2004 | Westerhold | |
| 2004/0140315 | A1 | 7/2004 | Reinoso | |
| 2004/0247749 | A1 | 12/2004 | Lambert et al. | |
| 2005/0092760 | A1 * | 5/2005 | Westerhold | A47G 19/2255 220/703 |
| 2006/0273087 | A1 | 12/2006 | Crawford | |
| 2007/0062961 | A1 | 3/2007 | Rigas | |
| 2009/0065377 | A1 | 3/2009 | Olomi et al. | |
| 2011/0297706 | A1 | 12/2011 | Zoss | |
| 2012/0168451 | A1 | 7/2012 | Lee | |
| 2012/0292283 | A1 | 11/2012 | Kornbrust | |
| 2014/0147559 | A1 | 5/2014 | Aidan | |
| 2014/0332440 | A1 * | 11/2014 | Marcus | A47G 23/02 206/591 |

FOREIGN PATENT DOCUMENTS

| | | | |
|---|---|---|---|
| CN | 202477425 | | 10/2012 |
| DE | 2641874 | A1 | 3/1978 |
| GB | 867346 | A | 5/1961 |
| GB | 2045730 | A | 11/1980 |

* cited by examiner

PORTABLE DRINKING VESSEL ASSEMBLY

FIELD OF THE INVENTION

The present invention relates generally to a portable drinking vessel assembly that detachably attaches to a bottle to facilitate drinking a liquid directly from the bottle, and simultaneously aerates the liquid while pouring from the bottle. More so, the present invention relates to a drinking vessel that removably engages an open end of a bottle neck to enable drinking directly from a bottle while simultaneously aerating the liquid as it flows out of the bottle, and further detachably attaching to a stand that maintains the vessel in an upright position; whereby the assembly comprises a vessel defined by a side wall that forms a cavity, a bottom portion that forms a bottom opening, and a top portion that forms a top opening, which are continuous so that a liquid can be held therein; whereby a tapered conduit defined by a wide end and a narrow end integrally joins with the vessel through the wide end and detachably attaches to the bottle through the narrow end; whereby the liquid is oxidized while flowing from the narrow end, to the wide end, and finally into the vessel; whereby a silicone sleeve defined by a plurality of ribs that encapsulate a substantial longitudinal portion of the conduit; whereby the ribs engage an inner surface of the bottle neck to create a self-tapping rotatable action in the bottle neck, and a seal against the inner surface of the bottle neck; and whereby a lid detachably attaches to the top portion of the vessel to selectively seal the cavity.

BACKGROUND OF THE INVENTION

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

It is known to provide a bottle for containing consumable liquids. Typically, the bottle is generally cylindrical with a closed end and an open end. Generally, the liquid contents are not consumed directly form the bottle. Further, when liquid is poured through the open end into a cup, the liquid may be spilled. A wine bottle is a bottle used for holding wine, generally made of glass. Typically, a wine bottle holds about 750 milliliters of wine. Some wines are fermented in the bottle, others are bottled only after fermentation.

Generally, a single serving wine bottle is a smaller versions of standard 750 ml. wine bottles, and generally have a metal cap. Once purchased, the cap is removed and the contents are poured into a separate glass for consumption. In situations when a glass is not available, the wine could be consumed directly from the bottle.

It is recognized that often, wine bottles are too large and heavy for the user to drink the beverage straight out of the bottle, and using a glass or cup is preferred. Under many circumstances, a glass or a cup is, however, not readily available. It is also recognized that a miniature bottle of alcohol is difficult to drink from because the opening from which the liquid is dispensed is small and narrow.

Furthermore, it is generally considered socially unacceptable to drink directly from any wine bottle, let alone a mini-bottle of wine. Thus it would be advantageous to alleviate the problem of drinking directly from such bottles while providing a drinking vessel assembly that aerates the wine as it flows from the bottle and creates a seal with the bottle neck to prevent leakage and inhibit formation of air bubbles in the wine.

It is known in the art that letting wine breathe, or aerate, improves its taste. This is because tannins are the chemicals that make wine astringent; they are what make the mouth pucker and feel dry after taking a sip. In older vintages, tannins break down in the bottle as the wine's bouquet evolves. In young, full-bodied reds, however, tannins can overwhelm a wine's more delicate flavors. Aerating wine lessens its astringency by breaking down its tannins and opening up its bouquet.

Other proposals have involved containers that operate with bottles of consumable liquid. The problem with these containers is that they are not portable and easily detachable from the bottle. Also, they do not work to aerate the liquid as it pours out the bottle. Even though the above cited containers meets some of the needs of the market, a portable drinking vessel assembly that serves as an accessory to wine bottles that facilitates drinking a liquid directly from the bottle while also aerating the liquid is still desired.

SUMMARY

Illustrative embodiments of the disclosure are generally directed to a portable drinking vessel assembly. The portable drinking vessel assembly serves as an accessory to facilitate drinking a liquid directly from a bottle. The portable drinking vessel assembly removably engages an open end of a bottle neck to enable drinking directly from a bottle while simultaneously aerating the liquid.

The portable drinking vessel assembly comprises a vessel defined by a side wall, a bottom portion forming a bottom opening, and a top portion forming a top opening. A tapered conduit having a wide end and a narrow end integrally joins with the vessel through the wide end, and detachably attaches to the bottle through the narrow end. The liquid is aerated due to thinning out, while flowing through a small opening in the narrow end, to a large opening in the wide end, and finally into the broad surface area of the vessel.

A silicone sleeve having a plurality of ribs encapsulates a substantial longitudinal portion of the conduit. The ribs engage an inner surface of the bottle neck to create a self-tapping rotatable action in the bottle neck, and a seal against the inner surface of the bottle neck. The conduit detachably attaches to a stand to maintain an upright position. A detachable lid covers the top opening.

In some embodiments, the portable drinking vessel assembly may include a vessel defined by a side wall, a bottom portion that forms a bottom opening, and a top portion having a rim that forms a top opening. The sidewall, the top portion, and the bottom portion are generally continuous and form a cavity.

In some embodiments, the portable drinking vessel assembly may include a tapered conduit that is defined by a wide end that forms a large opening and a narrow end that forms a small opening. The narrow end integrally joins with the bottom portion of the vessel, such that the small opening of the tapered conduit is in communication with the bottom opening of the vessel.

In some embodiments, the portable drinking vessel assembly may include a sleeve. The sleeve encapsulates a substantial longitudinal portion of the tapered conduit. The sleeve is defined by a plurality of ribs disposed in a spaced-apart relationship. The ribs may be generally flexible, so as to enable rotatable coupling by the tapered conduit.

In some embodiments, the portable drinking vessel assembly may include a stand that is defined by a base and a tube. The tube has a first end that joins with the base, and a second end that detachably joins with the wide end of the conduit. The tube is sized and dimensioned to receive the conduit in a snug relationship while engaging the ribs of the sleeve.

In some embodiments, the portable drinking vessel assembly may include a lid defined by a lid edge. The lid at least partially covers the top opening of the vessel, and in doing so, the lid edge engages the rim of the vessel. In this manner, access to a liquid in the cavity of the vessel is regulated.

One objective of the present invention is to provide a portable drinking vessel assembly that detachably attaches to a bottle to enable direct drinking from the bottle.

Another objective is to provide a tapered conduit that spreads the liquid contents of the bottle out thinly to create aeration in the liquid flowing into the vessel.

Another objective is to provide a sleeve with ribs that creates a self-tapping effect against the inner surface of the bottle neck.

Yet another objective is to provide ribs on the sleeve that form a seal against the inner surface of the bottle neck.

Yet another objective is to enable the vessel to be used with a variety of bottles.

Yet another objective is to provide an inexpensive to manufacture portable drinking vessel assembly that can be used with wine bottles.

Other systems, devices, methods, features, and advantages will be or become apparent to one with skill in the art upon examination of the following drawings and detailed description. It is intended that all such additional systems, methods, features, and advantages be included within this description, be within the scope of the present disclosure, and be protected by the accompanying claims and drawings.

BRIEF DESCRIPTION OF THE DRAWINGS

The invention will now be described, by way of example, with reference to the accompanying drawings, in which.

Like reference numerals refer to like parts throughout the various views of the drawings.

DETAILED DESCRIPTION OF THE INVENTION

Figure 1:
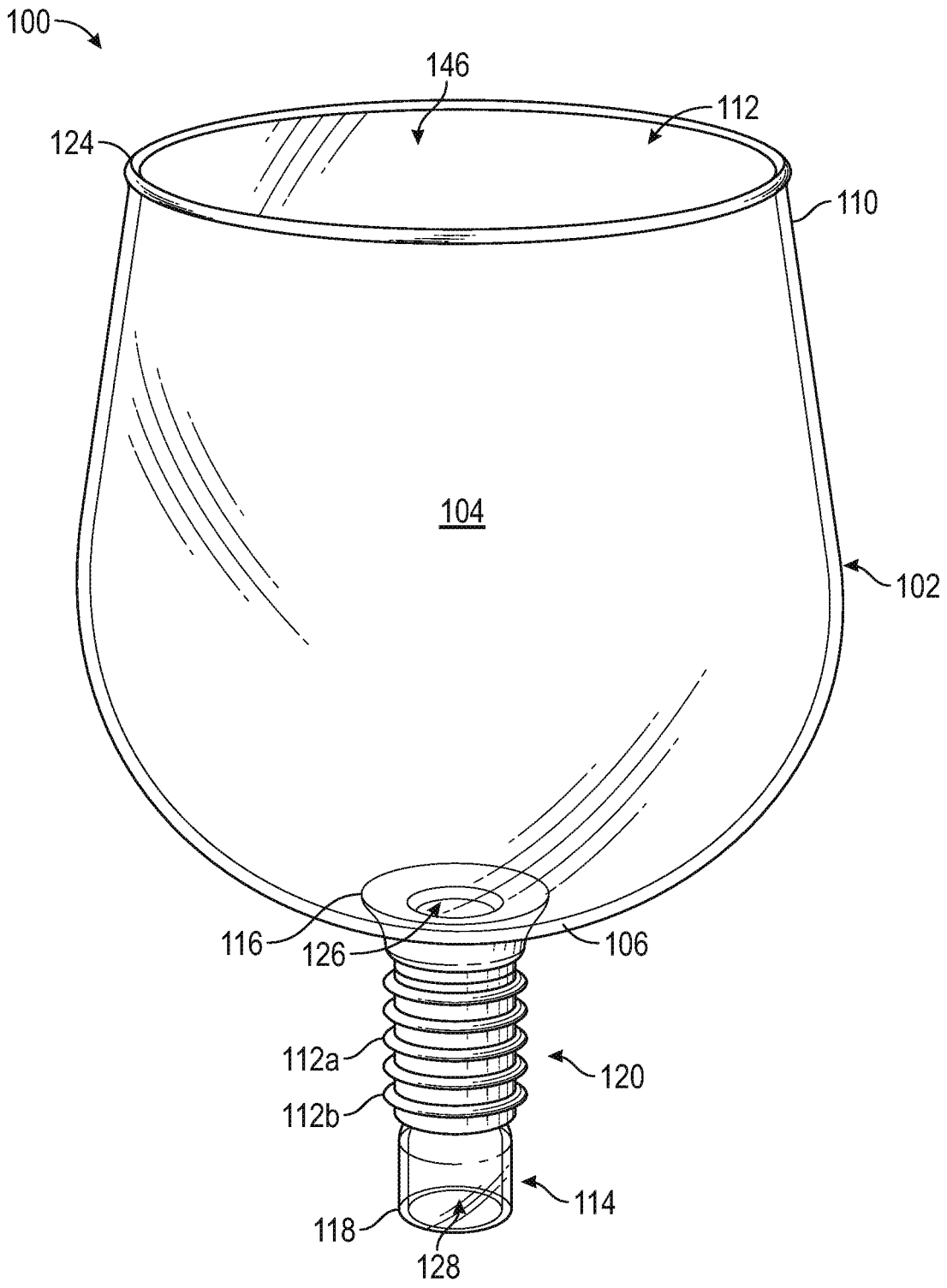
FIG. 1 illustrates a perspective view of an exemplary portable drinking vessel assembly, in accordance with an embodiment of the present invention.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper," "lower," "left," "rear," "right," "front," "vertical," "horizontal," and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Specific dimensions and other physical characteristics relating to the embodiments disclosed herein are therefore not to be considered as limiting, unless the claims expressly state otherwise.

A portable drinking vessel assembly 100 and attached bottle 200 are referenced in FIGS. 1-7. The portable drinking vessel assembly 100 provides a portable drinking container that enables consumption of a liquid, such as wine, directly from a bottle 200, while simultaneously aerating the liquid as it flows from the bottle 200 to the assembly 100. The portable drinking vessel assembly 100, hereafter "assembly 100" removably couples to an opening in a bottle neck 202, so as to enable passage of the liquid to a drinking vessel 102 and subsequent drinking of the liquid directly from the bottle 200 from the vessel 102. The liquid flows from the bottle 200 to the vessel 102 through a tapered conduit 114 that aerates the liquid while it flows from the bottle 200 to the vessel 102.

The assembly 100 also utilizes a sleeve 120 that is sized and dimensioned to snugly encapsulate the conduit 114. The sleeve 120 comprises a plurality of ribs 122*a*, 122*b* that engage the inner surface of a bottle neck 202 to create a self-tapping effect with the bottle 200. The ribs 122*a*, 122*b* also form a seal between the inner surface of the bottle neck 202 and the conduit. This helps to restrict leakage and inhibit undesirable formation of air bubbles in the liquid from the bottle 200. The assembly 100 may also detachably attach to a stand 134 to maintain the vessel 102 in an upright position. In alternative embodiments, a lid 130 detachably covers a top opening 112 in the vessel 102, so as to regulate access to the liquid contents therein.

Those skilled in the art will recognize that often, wine bottles are too large and heavy for the user to drink the beverage straight out of the bottle, and using a glass or cup is preferred. Under many circumstances, a glass or a cup is, however, not readily available. It is also recognized that a miniature bottle of alcohol is difficult to drink from because the opening from which the liquid is dispensed is small and narrow.

Furthermore, it is generally considered socially unacceptable to drink directly from any wine bottle, let alone a mini-bottle of wine. Thus it would be advantageous to alleviate the problem of drinking directly from such bottles while providing a portable drinking vessel assembly that aerates the wine as it flows from the bottle and creates a seal with the bottle neck to prevent leakage and inhibit formation of air bubbles in the wine. Thus, a vessel that detachably attaches to multiple wine bottles and is portable may be especially useful in the airline industry, the alcoholic beverage industry, bars, hotels, clubs, or anywhere wine is served. Such a drinking assembly may also be employed with wine coolers or other alcoholic beverages.

As referenced in FIG. 1, the assembly 100 comprises a vessel 102 defined by a side wall 104, a bottom portion 106 that forms a bottom opening 108, and a top portion 110 having a rim 124 that forms a top opening 112. The sidewall 104, the top portion 110, and the bottom portion 106 are generally continuous and form a cavity 146. In some embodiments, the vessel 102 may have a generally bell-shape. Though in other embodiments, the vessel may be configured into other shapes. In one embodiment, the vessel 102 is fabricated from lead-free borosilicate.

Figure 2:
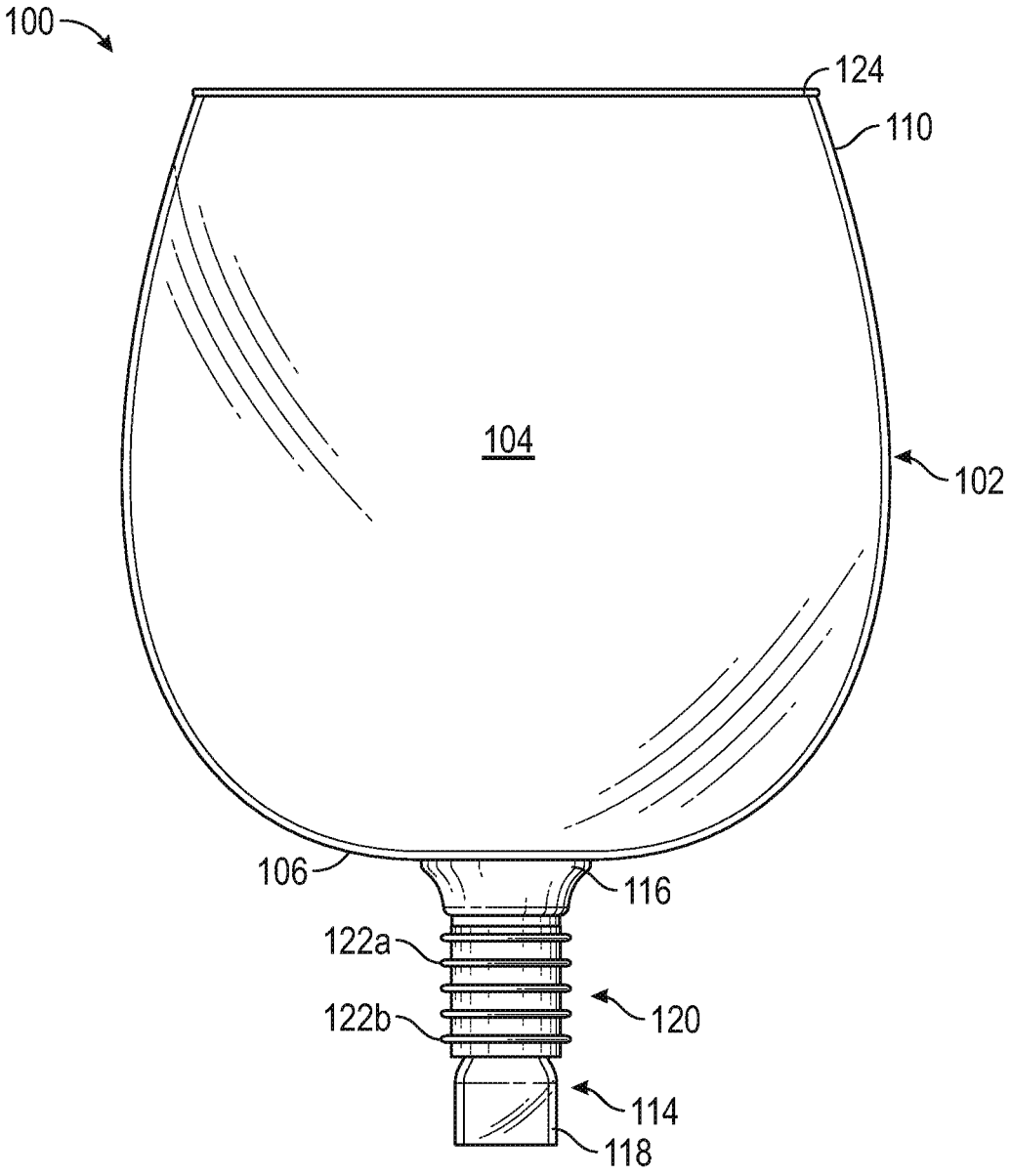
FIG. 2 illustrates an elevated side view of the portable drinking vessel assembly shown in FIG. 1, in accordance with an embodiment of the present invention.

Turning now to FIG. 2, the vessel 102 is configured to receive a liquid from the bottle 200, and provide comfortable drinking from a rounded rim 124 that forms along the top opening 112 of the vessel 102. In one possible embodiment, the top portion 110 of the vessel 102 is generally wider than the bottom portion 106. The top opening 112 that forms in the top portion 110 is defined by a rim 124 that has a generally rounded configuration. Those skilled in the art will recognize that the rounded configuration of the rim 124 provides a comfortable surface for engaging the lips during consumption of the liquid.

As discussed above, the sidewall 104, the top portion 110, and the bottom portion 106 that make up the vessel 102 are generally continuous, so as to contain a liquid for temporary containment during consumption. The liquid may include, without limitation, wine, whiskey, beer, grape juice, and water. The liquid may flow freely between a bottle 200 and the vessel 102.

Figure 3:
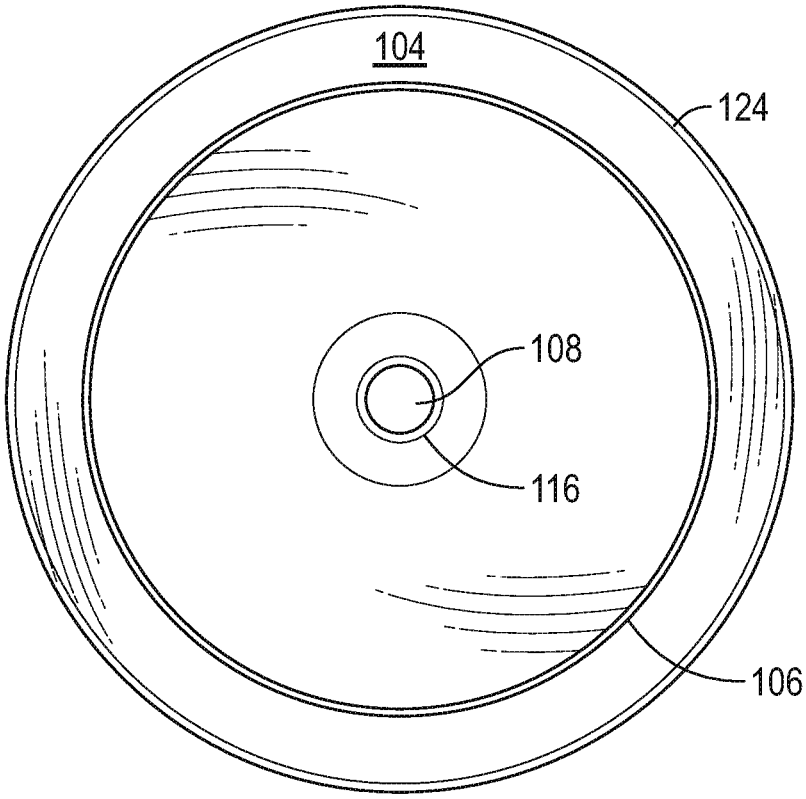
FIG. 3 illustrates a top view of the portable drinking vessel assembly shown in FIG. 1, in accordance with an embodiment of the present invention.

As referenced in FIG. 3, the flow of liquid between bottle 200 and vessel 102 passes through a generally tapered conduit 114 that works to aerate the liquid. This aeration is possible because the liquid thins out and occupies greater surface area while flowing from the generally narrow neck opening in the bottle neck 204 to the wider vessel 102, and similarly, from the narrow end 118 of the conduit 114 to the wide end 116 of the conduit 114. In one embodiment, the conduit 114 is fabricated from lead-free borosilicate, similar to the integrally formed vessel 102.

The conduit 114 is configured to carry the liquid between the bottle 200 and vessel 102. The conduit 114 is defined by a wide end 116 and a narrow end 118. The wide end 116 integrally joins the conduit 114 with the vessel 102. The narrow end 118 of the conduit 114 detachably attaches to the bottle 200. The liquid is aerated, or oxidized, while flowing from the narrow end 118, to the wide end 116, and finally into the vessel 102. The aeration occurs chiefly because the liquid occupies greater volume and becomes thinner while flowing from the narrower inlet of the neck opening 204 in the bottle neck 202 to the wider surface area at the wide end 116 of the conduit 114 and finally the vessel 102. This effect is similar to a funnel.

Those skilled in the art will recognize that allowing wine to breathe, or aerate, improves its taste. This is because tannins are the chemicals that make wine astringent; they are what make the mouth pucker and feel dry after taking a sip. In older vintages, tannins break down in the bottle as the wine's bouquet evolves. In young, full-bodied reds, however, tannins can overwhelm a wine's more delicate flavors. Aerating wine lessens its astringency by breaking down its tannins and opening up its bouquet.

Figure 4:
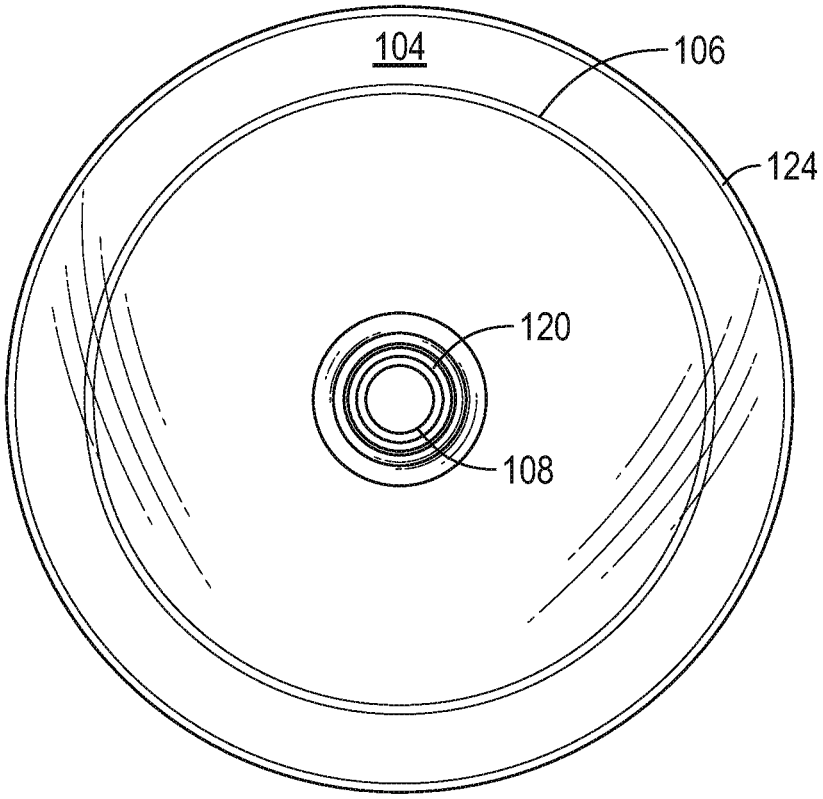
FIG. 4 illustrates a bottom view of the portable drinking vessel assembly shown in FIG. 1, in accordance with an embodiment of the present invention.

As FIG. 4 shows, both openings 126, 128 formed in the conduit 114 are in communication with the bottle 200 and the vessel 102. The wide end 116 of the conduit 114 integrally joins with the bottom portion 106 of the vessel 102. The narrow end 118 of the conduit 114 detachably couples to the neck opening 204 formed in the bottle neck 202. In one embodiment, the tapered conduit 114 may be inserted into the neck opening 204 with a gentle screwing motion. Those skilled in the art will recognize that the gentle screwing motion allows for a tighter seal and a more secure attachment between the conduit 114 and the bottle neck 202.

Figure 7:
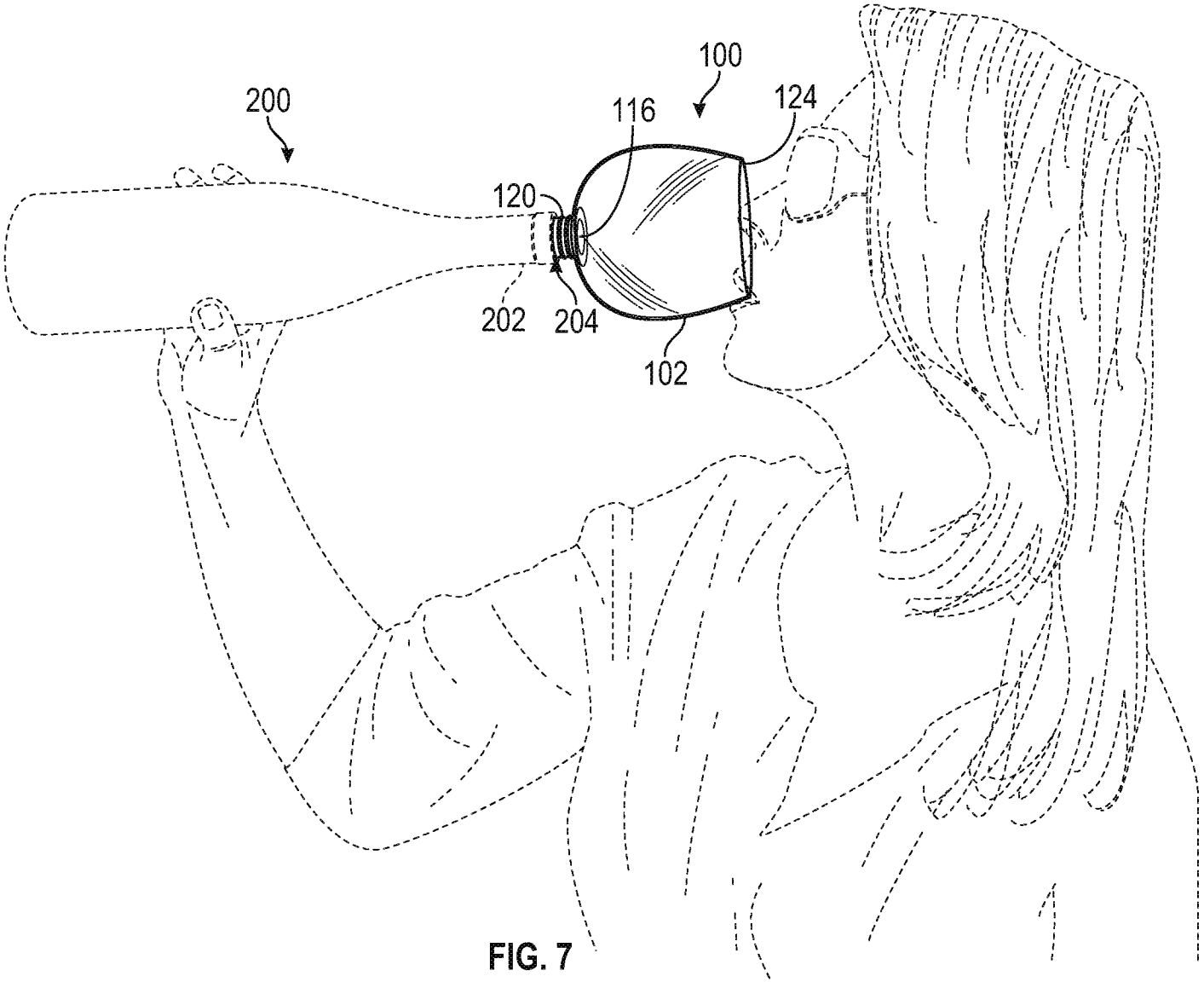
FIG. 7 illustrates a perspective view of the portable drinking vessel assembly shown in FIG. 1 coupled to a bottle that is tilted to enable drinking from a vessel, in accordance with an embodiment of the present invention.

In some embodiments, the conduit 114 gradually widens from the bottle 200 to the vessel 102, similar to a funnel. This tapered effect helps aerate the liquid, as the liquid is thinned out over a larger surface area while flowing from the narrower neck opening 204 of the bottle neck 202. In this manner, gravity carries the liquid to flow from the bottle 200 to the vessel 102 when the bottle 200 is tipped at an angle, so that the liquid may be consumed directly form the vessel 102. This flow of liquid from the bottle 200 to the vessel 102 is shown in FIG. 7.

Conversely, the liquid freely flows back from the vessel 102 into the bottle 200 after consumption, when the bottle 200 is oriented back into the upright position. In this manner, the liquid may be stored in the bottle 200 for subsequent consumption.

Looking back at FIG. 1, the assembly 100 further comprises a sleeve 120. The sleeve 120 may be fabricated from a generally resilient, silicone material. The sleeve 120 is configured to encapsulate a substantial longitudinal portion of the conduit 114. In one embodiment, the sleeve 120 encapsulates the entire length of the tapered conduit 114. The sleeve serves as a bonding component that seals the assembly 100 to the bottle 200, while also creating a self-tapping effect by the assembly 100 in the bottle 200. In one embodiment, the sleeve 120 is fabricated from a resilient silicone material.

The sleeve 120 may include a plurality of ribs 122*a*, 122*b* that are disposed in a spaced-apart relationship. The ribs 122*a*, 122*b* are configured to be generally flexible and fabricated from the same silicone material as the sleeve 120. The ribs 122*a*, 122*b* enable rotatable coupling by the conduit 114 to the inner surface of the bottle neck 202. The rotatable coupling allows the ribs 122*a*, 122*b* to engage the inner surface, which creates a self-tapping effect. This is unique in that the inner surface of the bottle neck 202 is generally smooth. Thus, the ridge-like projections of the ribs 122*a*, 122*b* on the sleeve 120 are forced to collapse in such a way that self-tapping occurs. As shown in FIGS. 1 and 2, a space between adjacent ones of the plurality of ribs 12*a*, 122*b* is greater than a thickness of a respective one of the plurality of ribs 122, 122*b*. Further, a space between adjacent ones of the ribs 12*a*, 122*b* is greater than a radial height of the plurality of ribs 122*a*, 122*b*.

The self-tapping effect is possible because the engagement is generally snug, which allows the spaces between individual ribs 122*a*, 122*b* to form small vacuums between each other that helps to draw liquid from the bottle 200. The ribs 122*a*, 122*b* also from a seal against the inner surface of the bottle neck 202, so as to restrict leakage of liquid and to prevent the formation of undesirable air bubbles in the liquid.

Looking back at FIG. 2, the sleeve 120 comprises a plurality of ribs 122*a*, 122*b*. The ribs 122*a*, 122*b* are disposed in a spaced-apart relationship and have a generally flexible configuration. The ribs 122*a*, 122*b* cooperate with the inner surface of the bottle neck 202 to enable a snug, rotatable engagement. This communication creates a self-tapping rotatable action in the bottle neck 202; whereby the tapered conduit 114 screws in and out of the bottle neck 202 while maintaining a snug fit therein.

Additionally, the snug engagement allows the ribs 122*a*, 122*b* to form a seal against the inner surface of the bottle neck 202. This inhibits leakage and prevents undesirable formation of air bubbles in the liquid. In this manner, the vessel 102 can function as a drinking cup when coupled to the neck of the bottle and inverted.

Figure 5:
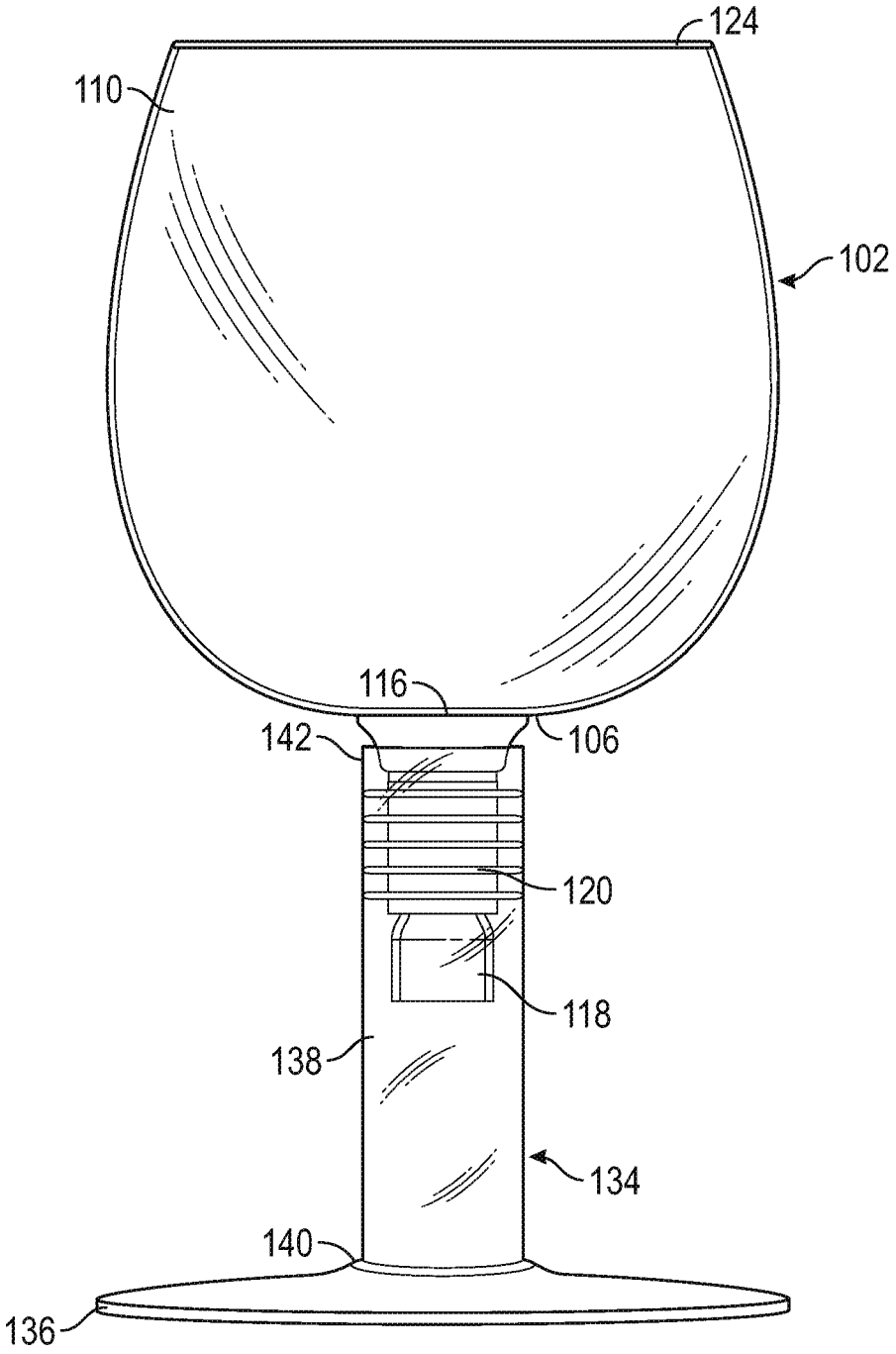
FIG. 5 illustrates an elevated side view of the portable drinking vessel assembly joined with an exemplary stand, in accordance with an embodiment of the present invention.

As FIG. 5 illustrates, the assembly 100 may include a stand 134 for providing upright support and stability. The stand 134 is defined by a base 136 and a tube 138 that integrally join. The base 136 is generally flat and forms a stable foundation for supporting the vessel 102 in an upright position. This may be useful for when the assembly 100 is not in use. The tube 138 may include a first end 140 that integrally joins with the base 136, and a second end 142 that receives the conduit 114. The second end 142 forms an aperture 144 that enables passage of the conduit 114, so that at least a portion of the conduit 114 resides in the tube 138. In one embodiment, the tube 138 is sized and dimensioned to receive the conduit 114 and the ribbed sleeve 120 in a snug relationship.

Figure 6:
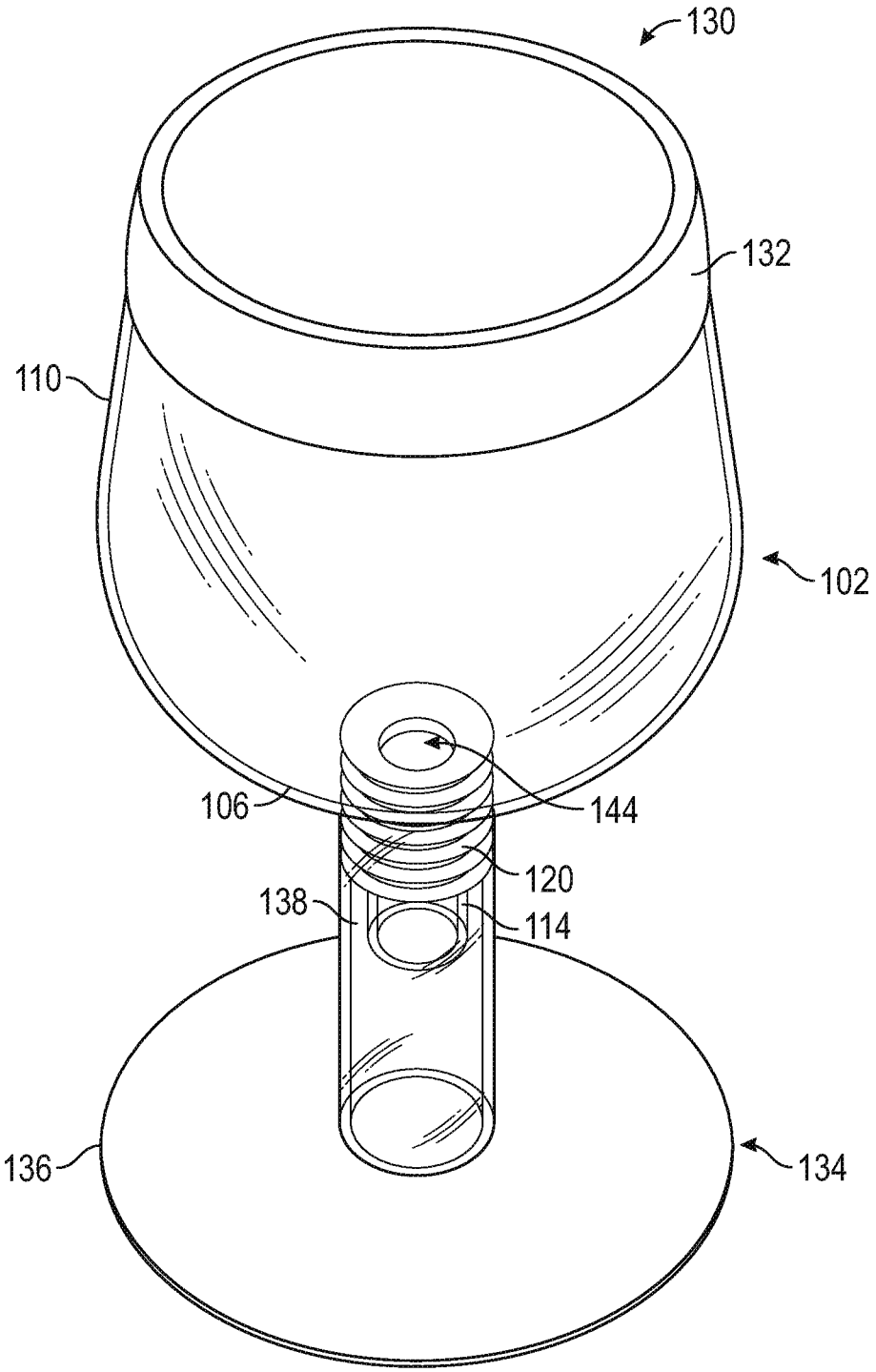
FIG. 6 illustrates an elevated side view of the portable drinking vessel assembly joined with a stand and covered with an exemplary lid, in accordance with an embodiment of the present invention.

Turning now to FIG. 6, alternative embodiments of the assembly 100 comprise a lid 130. The lid 130 serves to detachably cover the top opening 112 of the vessel 102. The lid 130 is defined by a lid edge 132 that aligns with the rim 124 of the vessel 102. In some embodiments, the lid edge 132 may snugly engage the rim 124. In this manner, access to a liquid in the cavity 146 of the vessel 102 is regulated. In one embodiment, the lid 130 is a rubber panel that detachably attaches to the rim 124 through a friction fit relationship.

In operation shown in FIG. 7, the vessel 102 is gripped by the sidewall 104 for manipulation. The large opening 126 in the wide end 116 of the tapered conduit 114 is aligned with the neck opening 204 of the bottle neck 202. The wide end 116 of the tapered conduit 114 is brought into rotatable engagement with the inner surface of the bottle neck 202, such that the neck opening 204 and the large opening 126 of the conduit 114 are in communication. Because of the spaced-apart disposition of the ribs 122*a*, 122*b*, the tapered conduit 114 can be twisted in a first direction against the bottle neck 202 until resistance prevents further hand tightening and the assembly 100 is fully coupled to the bottle 200. This rotational engagement serves to securely connect the assembly 100 to the bottle 200 and also to create a self-tapping effect.

At this point, the bottle 200 is tilted upwardly until the liquid flows through the tapered conduit 114 and into the vessel 102 for consumption. The tapered configuration enables the liquid to aerate while flowing into the vessel 102. The ribs 122*a*, 122*b* create a seal against the inner surface of the bottle neck 202 to prevent leakage and inhibit formation of air bubbles in the liquid. Upon finishing to drink, the bottle 200 is returned to an upright position so that the liquid flows back into the bottle 200. The assembly 100 may be removed from the bottle 200 by rotating the assembly 100 in a second direction, creating release between the ribs 122*a*, 122*b* and the inner surface of the bottle neck 202.

These and other advantages of the invention will be further understood and appreciated by those skilled in the art by reference to the following written specification, claims and appended drawings.

Because many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What is claimed is:

1. A portable drinking vessel assembly, the assembly comprising: a vessel defined by a side wall, a bottom portion that forms a bottom opening, and a top portion having a rounded rim that forms a top opening configured for drinking by a user, the side wall, the top portion, and the bottom portion being continuous and forming a cavity; a tapered conduit having a first end defined by a wide end that forms a first opening and a second end that forms a second opening, the wide end integrally joined with a bottom surface of the bottom portion of the vessel, and the second end adapted to be inserted into an opening in a bottle neck whereby the first opening of the tapered conduit is in communication with the bottom opening of the vessel; and a sleeve including a plurality of ribs disposed in a spaced-apart relationship thereon, the sleeve encapsulates a longitudinal portion of the tapered conduit, the plurality of ribs further configured to enable rotatable sealed coupling between the tapered conduit and an inner surface of the bottle neck, wherein the second end of the tapered conduit includes an outer radial enlargement relative to a medial portion of the tapered conduit, and the outer radial enlargement includes a truncated cone shape tapered toward the sleeve.

2. The assembly of claim 1, further comprising a stand, the stand defined by a base and a tube, the tube having a first end that integrally joins with the base, and a second end that receives the tapered conduit, whereby the tube is sized and dimensioned to receive the tapered conduit while engaging the plurality of ribs of the sleeve.

3. The assembly of claim 1, further comprising a lid defined by a lid edge.

4. The assembly of claim 3, wherein the lid is configured to at least partially cover the top opening of the vessel, whereby the lid edge engages the rounded rim of the vessel.

5. The assembly of claim 3, wherein the lid has a circular shape.

6. The assembly of claim 1, wherein the vessel has a bell-shaped configuration.

7. The assembly of claim 1, wherein the sleeve is fabricated from silicone.

8. The assembly of claim 1, wherein the vessel is fabricated from lead-free borosilicate.

9. The assembly of claim 1, wherein the assembly is configured to detachably attach to a bottle having the bottle neck, the bottle neck defined by a neck opening, the inner surface, and an outer surface.

10. The assembly of claim 1, wherein the plurality of ribs comprises 5 spaced apart ribs.

11. The assembly of claim 1, wherein the plurality of ribs extend radially beyond the outer radial enlargement.

* * * * *